United States Patent [19]

Farrant

[11] 4,373,315

[45] Feb. 15, 1983

[54] BUILDING ELEMENTS AND BUILDING METHODS

[75] Inventor: Herbert H. Farrant, Massey, New Zealand

[73] Assignee: John Kenneth Burrowes, Auckland, New Zealand

[21] Appl. No.: 130,170

[22] Filed: Mar. 13, 1980

[30] Foreign Application Priority Data

Mar. 14, 1979 [NZ] New Zealand ..... 189900

[51] Int. Cl.[3] ..... E04D 1/00

[52] U.S. Cl. ..... 52/522; 52/537

[58] Field of Search ..... 52/522, 536, 537, 542, 52/519, 530, 478, 529

[56] References Cited

U.S. PATENT DOCUMENTS

| | | | |
|---|---|---|---|
| 3,059,734 | 10/1962 | Tripp | 52/537 X |
| 3,245,187 | 4/1966 | May | 52/536 X |
| 3,399,916 | 9/1968 | Ensor | 52/522 X |
| 3,402,526 | 9/1968 | Baxter | 52/522 X |
| 3,559,359 | 2/1971 | Talbert | 52/522 X |
| 3,596,424 | 8/1971 | Ward | 52/478 X |
| 3,606,718 | 9/1971 | Curran | 52/542 |
| 3,699,737 | 10/1972 | Cookson | 52/478 X |

*Primary Examiner*—John E. Murtagh
*Assistant Examiner*—Carl D. Friedman

[57] ABSTRACT

A building element suitable for floors, walls, or roofs, has oppositely disposed U-shaped channels at either end of the element. Adjacent building elements can be overlapped so that their complementary channel members are interengaged to form a box section member to reinforce the completed cladding and also provide for the insertion of timber blocks or studs. The cladding can be fastened to a building structure by fasteners passing through the box section and through the spacer blocks of timber or other material.

1 Claim, 4 Drawing Figures

BUILDING ELEMENTS AND BUILDING METHODS

This invention relates to a building element and to a method of building utilising said element. It has particular application to a sheet building element suitable for use in the construction of a roof, wall or floor.

It is an object of this invention to provide an improved sheet building element which will at least provide the public with a useful choice.

In one aspect, the invention provides a sheet building element including: a sheet of substantially rigid material, having a plurality of upstanding complementary portions which, when two of said elements are overlapped one with another, said complementary portions can be combined to form a hollow section member.

In another aspect, the invention provides a building structure including: two or more overlapped sheet building elements as described in the preceding paragraph wherein a first complementary portion of one sheet combines with a second complementary portion of another sheet to form a hollow section member, timber elements being provided within said hollow section member to enable fasteners to pass through said overlapping first and second complementary portions of said overlapping sheets and through said timber elements to connect with a supporting framework.

Another aspect of this invention, which should be considered in all its novel aspects, will become apparent from the following description, which is given by way of example only, with reference to the accompanying drawings.

Figure 1:
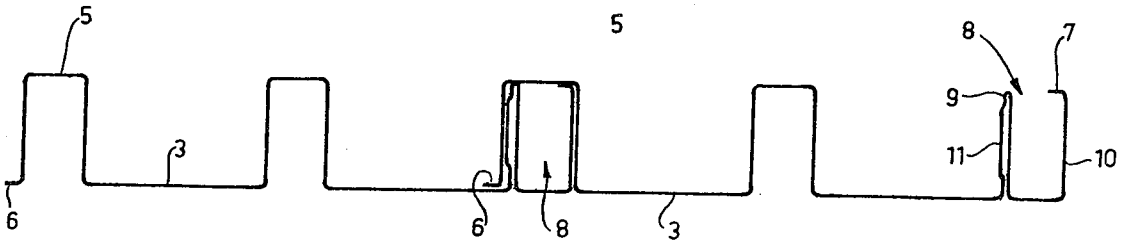
FIG. 1 illustrates an end view of a first pair of overlapping building elements.

Returning now to the structure illustrated in FIG. 1, there is shown a part of building elements 3 which may be formed from suitable sheet material. Each element is provided with one or more upstanding portions or ribs 5, each of which may take the form of an inverted U-shape. For example, the ribs 5 may be substantially rectangular in cross section so as to receive rectangular timber studs or frame elements.

In addition to the inverted U-shaped members 5, each sheet member has at least one complementary U-shaped member 8. Conveniently, the U-shaped member 8 is positioned at one end of the building element 3, whilst one of the inverted U-shaped members 5 is positioned at the other end of the building element.

The U-shaped member 8 is also substantially rectangular in cross section, so as to conform with the shape of a corresponding inverted U-shaped member 5. Conveniently, the member 8 has an outer wall 10 with an inwardly disposed flange 7. The inner wall of member 8 is preferably formed by folding over the sheet material to provide a double wall 9. This may function as a spring clip when engaged within the confines of the inverted U-shaped member 5 of an adjoining sheet. In addition, the double wall 9 may be provided with suitable channels for locating and weathering purposes.

Conveniently, the U-shaped members 5 and 8 are parallel one to another and are formed parallel to the edges 6 and 7 of each building element. Thus in use, adjacent building elements can be conjoined by overlapping adjacent sheets so that member 5 at one end of a sheet will fit over the element 8 of an adjoining sheet to thereby form a hollow section member as shown in FIG. 1. A timber block or timber stud may fit within this hollow section member. By inserting a timber block within the hollow section member, the building elements may be attached to the top and bottom plates in the construction of a wall, by passing a fastener through the overlapping sheets and through the inserted timber block and into the building structure.

Figure 2:
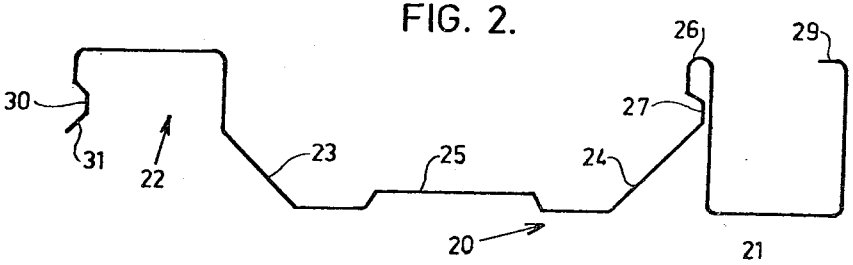
FIG. 2 illustrates an end view of a second building element.
Figure 3:
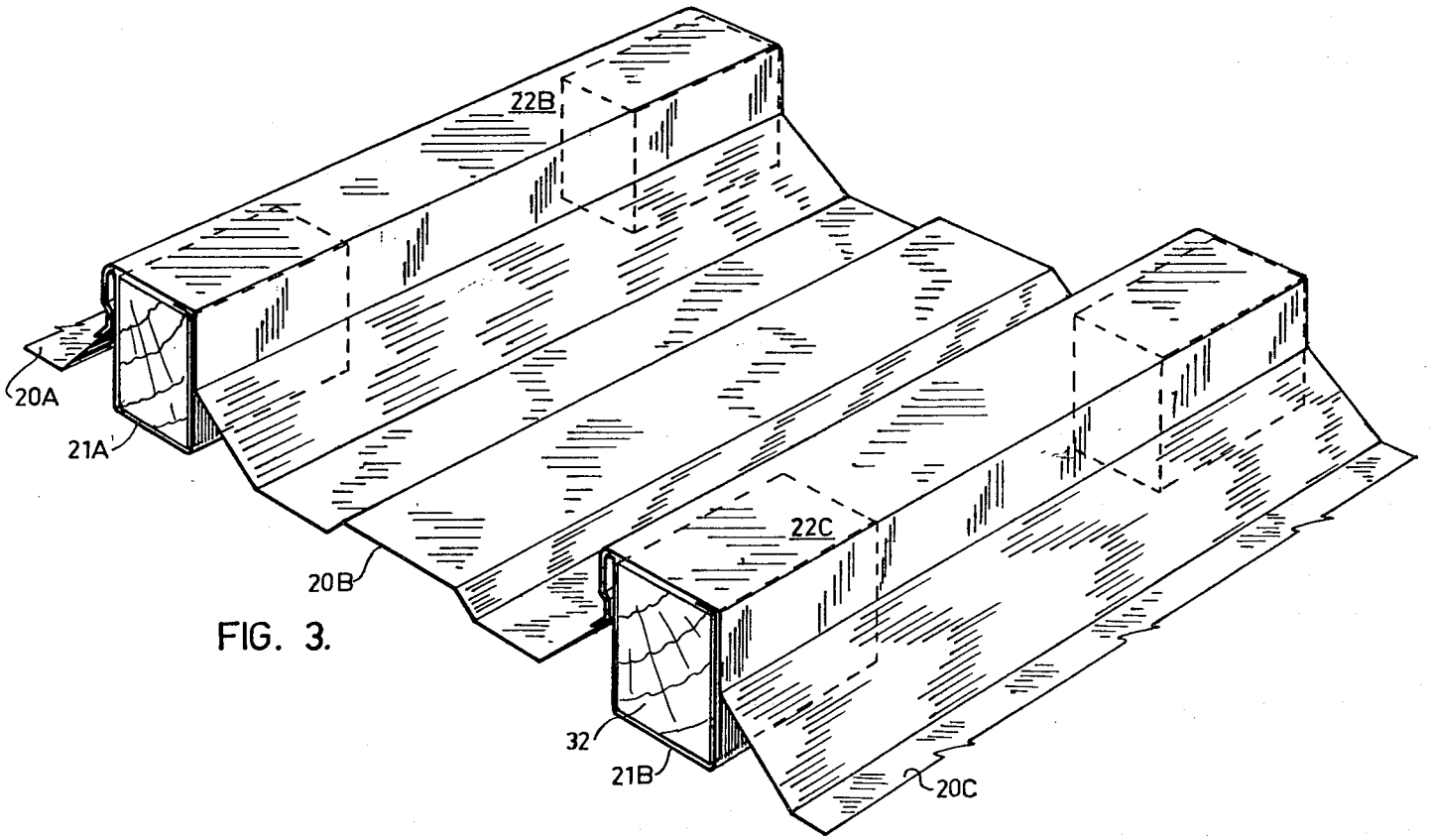
FIG. 3 illustrates the second building elements overlapping with one another to form hollow section members in which timber blocks may be inserted.
Figure 4:
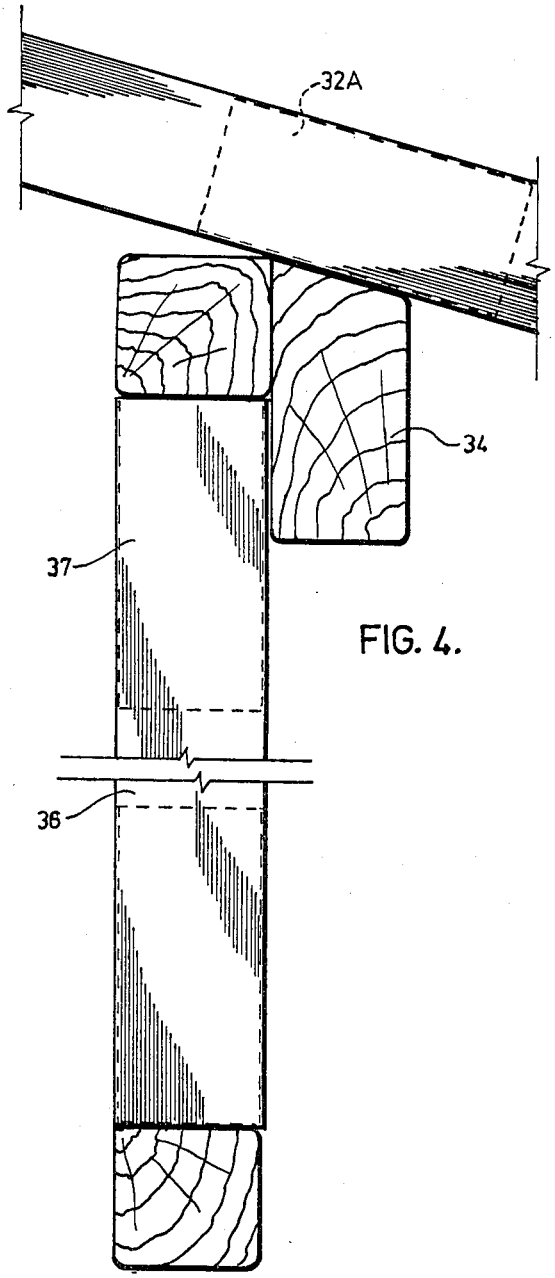
FIG. 4 illustrates the use of the building elements of FIG. 3 in both a wall and roof of a building.

Turning now to the embodiment shown in FIGS. 2–4, there is illustrated a modified building element 20. This has a first U-shaped member 21 at one end of the element, and a second inverted substantially U-shaped member 22 at the other end thereof. Each U-shaped member is conjoined to the remainder of the sheet by sloping side walls 23, 24. One or more reinforcing ribs 25 may be provided in the sheet between the first and second members 21 and 22.

The first U-shaped member 21 has an enlarged edge 26 formed by folding or rolling the sheet material into the shape illustrated in FIG. 2, having a recessed or narrow portion 27 adjacent the sloping side wall 24. In addition, there may be an inwardly facing flange 29 opposite the enlarged edge 26.

The second U-shaped member 22 is substantially complementary to the first member. That is to say, it has clip 30 capable of engaging with the enlarged edge 26. The edge 31 of the clip slopes outwardly at a similar angle to that of sloping wall 24.

FIG. 3 illustrates a series of building elements in overlapping relationship. Thus, member 22B sits over member 21A whilst member 22C sits over member 21B. It will be noted that only building element 20B is shown in full, whilst portions or overlapping sheets 20A and 20C are shown.

Situated within the hollow section member defined by overlapping members 21 and 22, there are a plurality of timber blocks 32. Fasteners such as nails, screws, or the like, may be passed through the overlapping members 21, 22 and through the timber blocks 32. For example, FIG. 4 illustrates a building structure in which the roof is formed by a series of overlapping elements 20, thereby defining a series of hollow section members extending down the roof line. A first timber block 32A may be inserted within such a hollow section member to enable the roof to be fastened to a top plate 34. The wall 36 may also be formed by a series of overlapping building elements 20, having a series of hollow section members extending vertically down the wall. Likewise, timber studs or timber blocks 37 may be positioned within the hollow section members of the wall to enable it to be fastened to top and bottom plates. For example, timber block 37 can be nailed to top plate 24.

It will be appreciated that the building elements may be formed from any suitable material, for example, by rolling, bending or presssing of sheet metal. A suitable sheet metal would be galvanised steel. However, it will be appreciated that other methods and materials may be used in forming the building elements, for example, they may be moulded out of reinforced plastic materials.

The overlapping of the sheets forms box section members providing for additional strength in the completed structure and moreover enables spacing or fixing blocks of timber, plastics or other materials, to be enclosed within the hollow section member, thereby hiding the blocks from view, as well as minimising weathering of the blocks. The blocks assist in preventing movement of the side walls of the box-section member, thereby reinforcing the completed structure and resisting unlocking of the overlapped elements. Moreover, the box-section member enables fasteners to be inserted from either face and thus a roof may be formed from overlapping elements without the need for separate timber rafters or purlins.

Finally, it will be appreciated that various alterations or modifications may be made to the foregoing without departing from the scope of this invention as exemplified by the following claims.

I claim:

1. A building structure comprising: two or more sheet building elements, each of said elements including a sheet of substantially rigid material having complementary interlocking means at or adjacent a pair of lateral edges thereof, a first of said interlocking means consisting of a substantially rectangular open topped trough having a flat base, and a second of said interlocking means consisting of an inverted substantially rectangular trough having a flat top and an open base, and clip means formed in said complementary means, whereby adjacent sheet building elements are conjoined by overlapping their adjacent edges so that a first and a second interlocking means are combined to form a substantially weather tight hollow substantially rectangular box section member to which linings or strappings can be attached by fasteners without damaging the weather tightness or integrity of the profile; and timber elements provided within said hollow substantially rectangular box section to pass through either of said sheet building elements into said timber elements for connection with a supporting framework.

* * * * *